US005785343A

United States Patent [19]

Challande et al.

[11] Patent Number: 5,785,343

[45] Date of Patent: Jul. 28, 1998

[54] APPARATUS FOR RETAINING BOOTS ON A GLIDING BOARD

[75] Inventors: Christian Challande, Cruseilles; Pierre Desarmaux, Evires, both of France; Hans Horn, Lysse, Switzerland

[73] Assignee: Salomon S.A., Metz-Tessy, France

[21] Appl. No.: 559,140

[22] Filed: Nov. 17, 1995

[30] Foreign Application Priority Data

Nov. 21, 1994 [FR] France ..... 94 14072

[51] Int. Cl.[6] ..... A63C 9/085

[52] U.S. Cl. ..... 280/634; 280/625

[58] Field of Search ..... 280/613, 625, 280/629, 630, 634, 635; 36/117.1, 117.3

[56] References Cited

U.S. PATENT DOCUMENTS

| | | | |
|---|---|---|---|
| 3,228,708 | 1/1966 | Miller | 280/625 |
| 3,666,280 | 5/1972 | Smolka et al. | 280/630 |
| 4,401,317 | 8/1983 | Horiuchi | 280/625 |
| 4,883,286 | 11/1989 | Hornschemeyer | 280/629 |
| 5,293,702 | 3/1994 | Miyoshi et al. | 36/117.3 |
| 5,615,498 | 4/1997 | Challande et al. | 36/117.3 |
| 5,639,108 | 6/1997 | Challande et al. | 280/613 |

FOREIGN PATENT DOCUMENTS

| | | |
|---|---|---|
| 313761 | 1/1974 | Austria . |
| 0302309 | 2/1989 | European Pat. Off. . |
| 1503847 | 12/1967 | France . |
| 1503848 | 12/1967 | France . |
| 1503849 | 12/1967 | France . |
| 2517214 | 6/1983 | France . |
| 1807074 | 5/1970 | Germany . |
| 1963149 | 6/1971 | Germany . |
| 2454577 | 5/1976 | Germany . |
| 2802251 | 7/1979 | Germany . |
| 4305327 | 3/1994 | Germany . |

*Primary Examiner*—Brian L. Johnson
*Assistant Examiner*—Frank Vanaman
*Attorney, Agent, or Firm*—Greenblum & Bernstein P.L.C.

[57] ABSTRACT

An assembly of two retention elements of two boots of a skier on two skis. Each retention element has a movable retention jaw, a return spring of the jaw, a transmission linkage of movement between the retention jaw and the spring, an adjustment mechanism acting on the transmission linkage to modify in a differential manner the release threshold of the jaw depending upon whether it displaces on one side or the other with respect to its aligned position and a movable manipulation button accessible from the exterior to control the adjustment mechanism.

22 Claims, 14 Drawing Sheets

Fig. 11
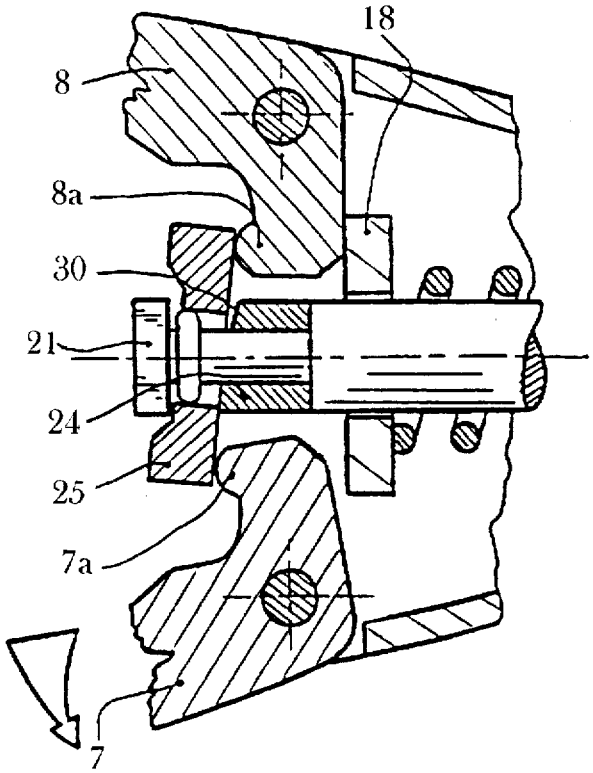
Fig. 12
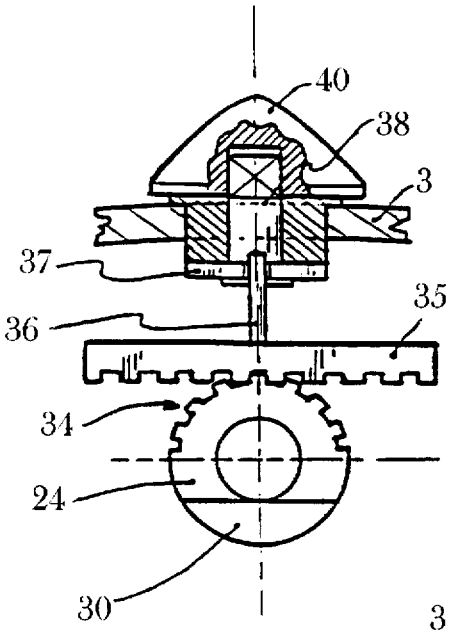
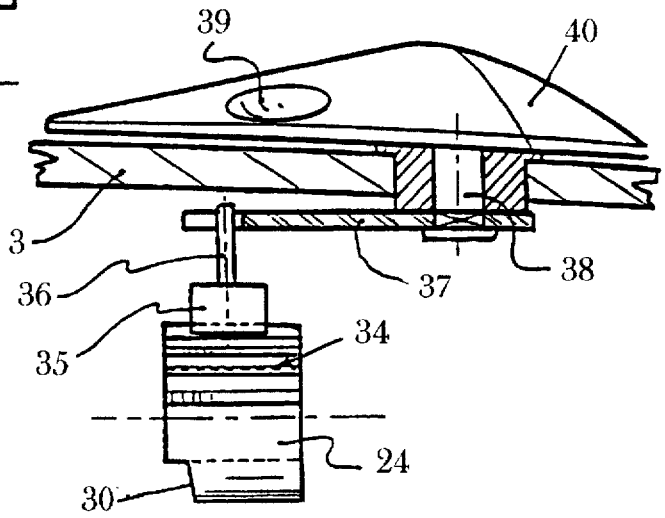
Fig. 13

Fig. 18
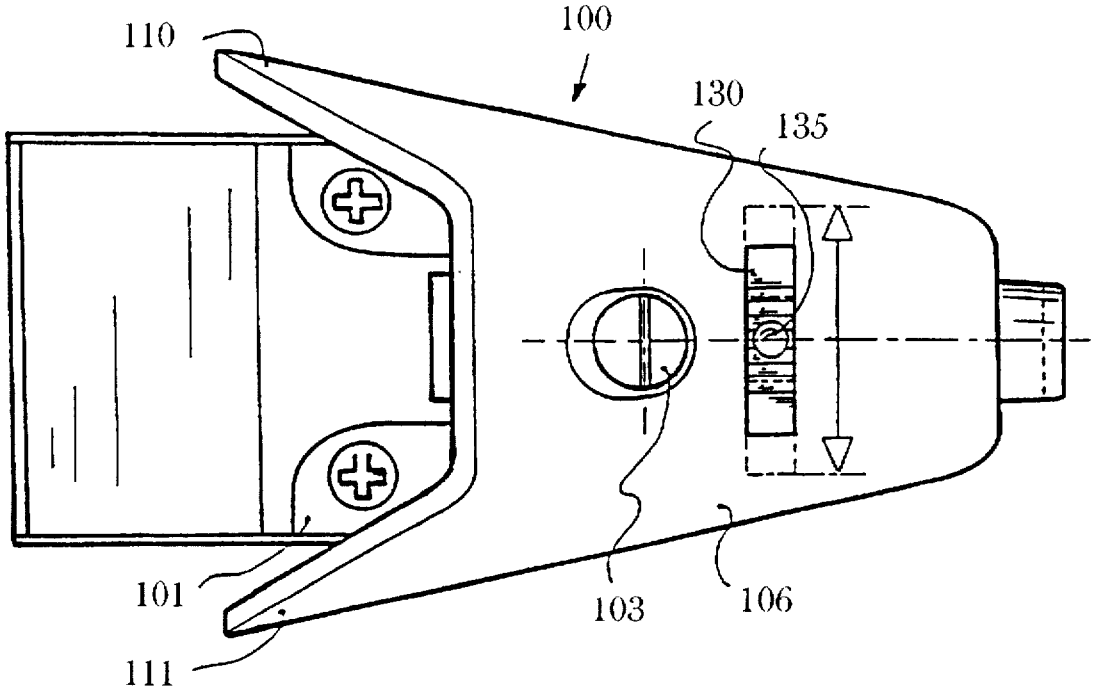
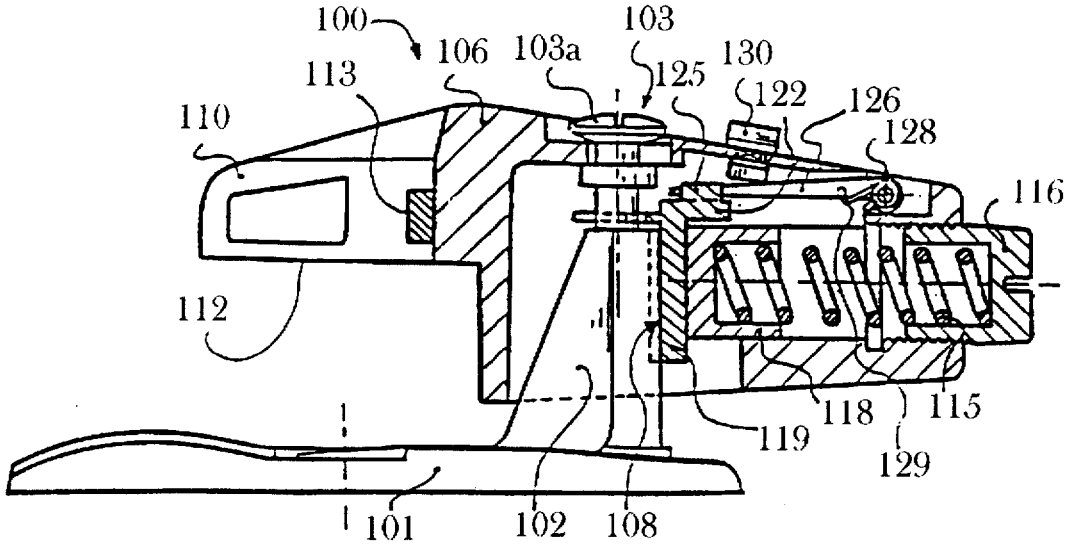
Fig. 19

Fig. 27
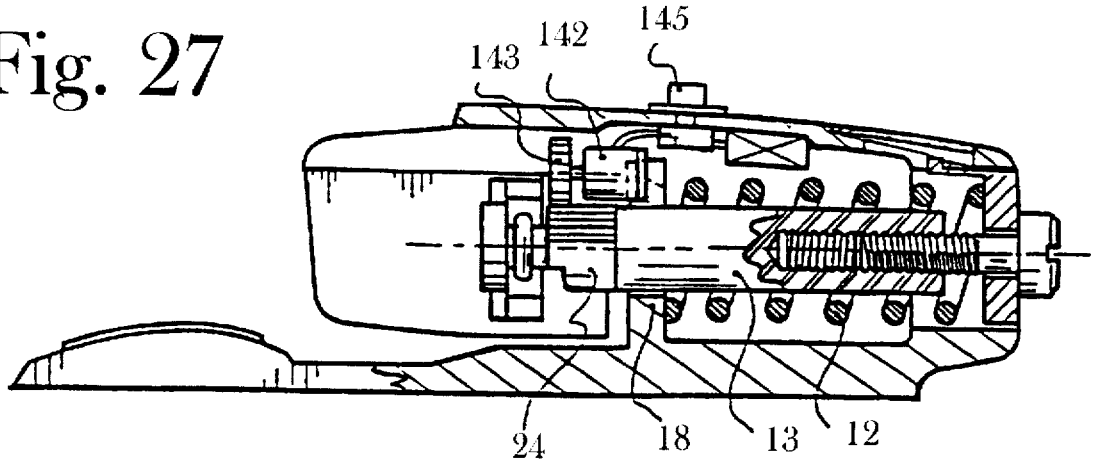
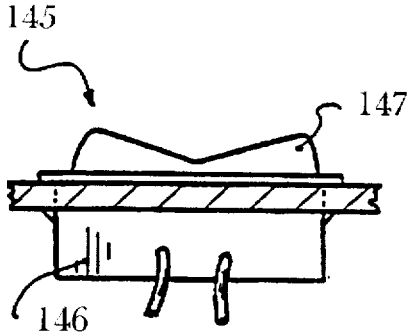
Fig. 28
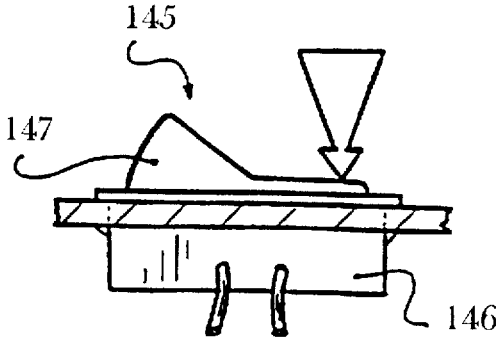
Fig. 29

APPARATUS FOR RETAINING BOOTS ON A GLIDING BOARD

BACKGROUND OF THE INVENTION

1. Field of the Invention

The present invention relates to an assembly of two retention elements adapted to a retention element and to retain boots of a skier on a pair of gliding boards, in particular a pair of skis.

The invention likewise relates to an assembly of two retention elements associated with an assembly of right and left boots for balb feet of a skier.

2. Description of Background

In the case of alpine skiing, it is known to retain a boot supported on a ski by means of a front binding element and a rear binding element which retain the front and rear tips of the boot. These two binding elements comprise a jaw carried by a body. The jaw is movable in response to bias of the boot against the return force of a spring which opposes its displacement.

The rigidity of the spring is adjustable, in a manner such that the boot is releved from the binding element for a bias exceeding a predetermined bias threshold. This threshold is commonly called a release threshold.

In order to be able to utilize boots with different binding elements on the market, the form of the front and rear tips of the boot has been standardized. In the ISO system of standardization, the applicable norm is ISO 5355. The binding elements, as to themselves, are adapted to be compatible with the normalized zones of the boot and to assure the release of the boot at predetermined release values.

In front, a boot is retained by a front retention or binding element whose jaw is movable at least laterally towards the interior or exterior of the foot. The jaw of the retention element is adapted to release the boot during an excessive torsional bias being exerted on the leg of the skier. The conventional bindings have a release threshold which is in general equal towards the interior and towards the exterior of the foot.

Yet, it is known that the knee of the skier, which is biased during a torsional fall is more fragile for rotation of the foot towards the interior than for rotation towards the exterior.

To take this into account, binding elements have been proposed which have a release threshold which differs depending upon the direction of rocking of the jaw. Such elements are for example described in French Patents Nos. 1,503,847; 1,503,848; 1,503,849; or further in German Patent Application published as No. 18 07 074.

The major disadvantage of this type of apparatus is that it requires a pairing between the boot and the skis, i.e., the right and left skis must necessarily be referenced, and the skier must in particular associate the right ski with the right boot and the left ski with the left boot. However, it is possible to reverse the skis, i.e., to put on for example the left ski with the right boot. In this case, the asymmetric effect during release of the binding works inversely, without it being possible to overcome it other than by exchanging the two skis.

The problem addressed by the invention is to improve the mode of operation of the existing retention elements. It comprises in particular providing the retention elements with an asymmetric release threshold, and improving the operation of such retention elements having an asymmetric release threshold.

This problem is resolved by the retention element assembly of a boot such as will be described below.

SUMMARY OF THE INVENTION

Each retention element has a retention jaw of the boot which is laterally movable, from both sides, towards the interior or exterior of the ski, against a return force of a spring. The jaw and the spring are adapted to release the boot beyond a predetermined release threshold. Each retention element is furthermore equipped with an adjustment mechanism, which makes it possible to adjust at will the release threshold of the retention element in asymmetrical fashion, according to the direction of displacement of the jaw, and with a control button or lever which makes it possible to activate the adjustment mechanism from the exterior . Thus, from the exterior, the skier can adjust at will the release threshold of his retention elements in a different manner depending upon whether they release the boot towards the interior or exterior of the foot.

Thus, whatever the direction in which the skier has arranged his skis for putting them on, or whatever the sense in which he has actually put on the skis, he can adjust his retention elements by means of buttons such that the release threshold of each of them is smaller for a release of the boot towards the exterior of the element than for a release towards the interior of the element.

According to one preferred secondary characteristic, the retention elements and the boot have visual indices which cooperate together to help in visualizing the position in which each button must be positioned. In effect, if one can easily invert the skis from right and left, it is not reasonable to exchange the right and left boots. The boots thus carry visual references which are for example symmetrical, from which the buttons of the two retention elements must be adjusted, in the manner so as to be somewhat polarized as a right element and a left element, respectively.

According to an alternative, the boots and the retention elements have mechanical references which do not allow for the engagement of the boot in the retention element other than when the control button is placed in the appropriate position corresponding to the position of the retention element, on the right or on the left.

BRIEF DESCRIPTION OF THE DRAWINGS

The invention will be better understood with reference to the description below and to the annexed drawings which are an integral portion thereof.

FIG. 11 corresponds to FIG. 9, with the other of the wings moved to an open position under the influence of a reduced return force.

FIG. 12 schematically illustrates in front view the linkage between the ring and the manipulation lever.

FIG. 13 shows in side view the construction of FIG. 12.

FIG. 18 illustrates a top view of a retention element in another embodiment the invention.

FIG. 19 shows a side view and in cross section the element of the preceding figure.

FIG. 27 is a side view in partial cross section of the element of FIG. 26.

FIG. 28 illustrates the control interrupter, seen in front view, in the median position.

FIG. 29 illustrates the interrupter in one of its polarization positions.

DETAILED DESCRIPTION OF THE INVENTION

Figure 1:
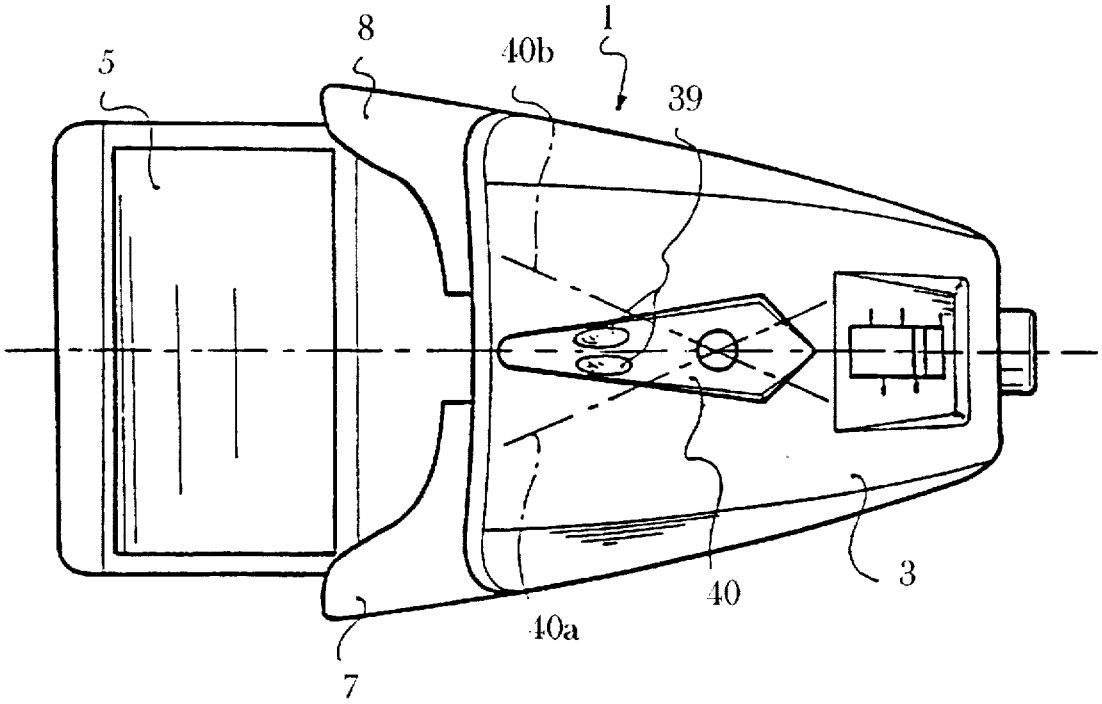
FIG. 1 is a general top view of a retention element according to a first embodiment of the invention.
Figure 2:
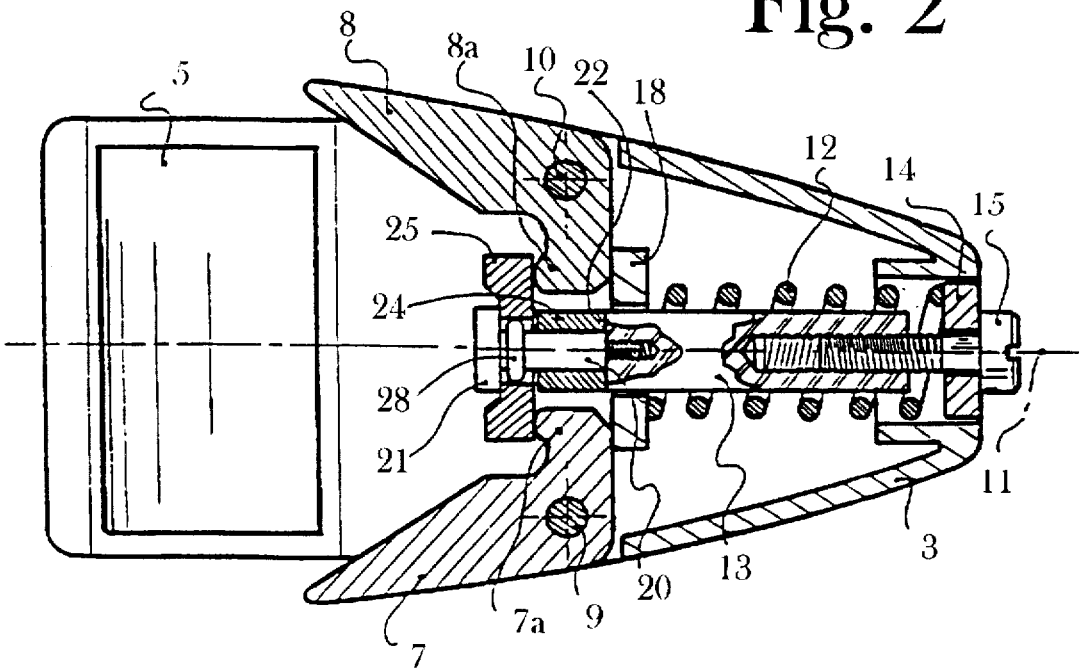
FIG. 2 is a top view in cross section of the retention element of FIG. 1.
Figure 3:
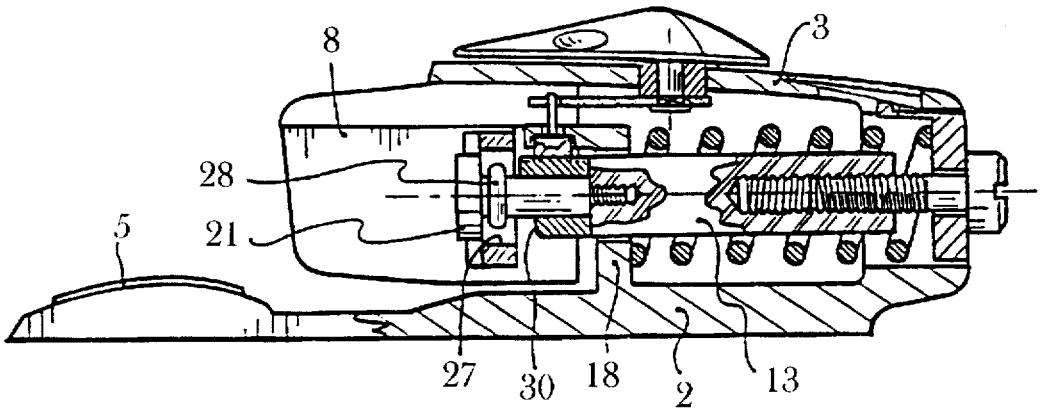
FIG. 3 is a lateral view in cross section of the element of FIG. 1.
Figure 4:
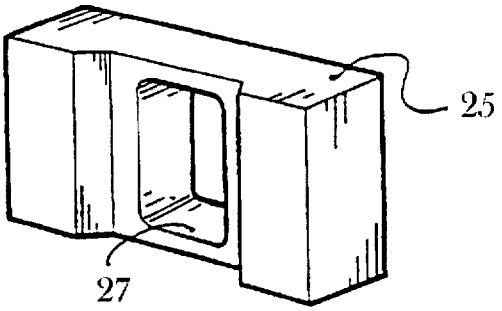
FIG. 4 is a perspective view of the rocker.
Figure 5:
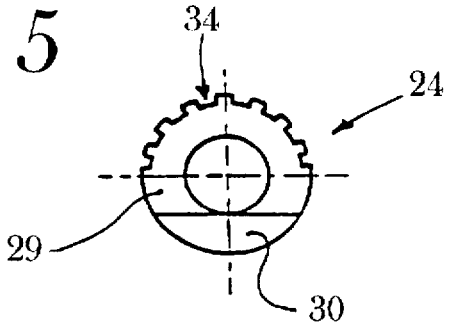
FIG. 5 is a front view of the polarization ring.
Figure 6:
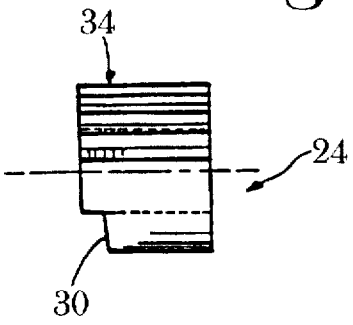
FIG. 6 is a side view of the ring of FIG. 5.

FIGS. 1–3 illustrate, by way of illustration of the invention, a retention 1 of an element assembly comprising two elements. The two elements of the assembly are constructed in an identical manner. To simplify the notation of the references, the same reference numerals will be used for the same elements of the two retention elements, when they are designated in a general manner, and prime and double prime references will be used when they designate a specific element of the prime retention element or of the double prime retention element, respectively, of the assembly.

Element 1 shown in FIGS. 1–3 comprises a base 2 capped by a hollow body 3 having a lateral wall and an upper cap. Base 2 extends towards the rear to form a support plate 5 adapted to receive the sole of the boot.

The retention element has furthermore a jaw formed of two wings 7 and 8 for retention of the boot. In the mode of representation shown in the figures, the wings are independent, respectively journalled around vertical axes 9 and 10. The wings extend respectively towards the interior, beyond axes 9 and 10 through returns 7*a* and 8*a*. Furthermore, the wings comprise a sole clamp which assures the vertical retention of the boot, in addition to the lateral retention. This is not limiting, and the jaw could have another nature, particularly it could be monoblock, fixedly connected to a body pivotably mounted around a central pivot. Numerous known constructions are possible. At rest, the jaw has a position substantially aligned with the longitudinal axis defined by the ski. In the case illustrated, at rest, the wings 7 and 8 are closed towards the longitudinal median axis 11 which is schematically illustrated in FIG. 2.

The body 3 of the retention element houses a spring 12, to which is transmitted the biases that the boot exerts on the wings of the jaw, and which, in return, exert an elastic force of return on the wings in a direction of their respective rest positions.

The spring is connected to the jaw by a movement transmission linkage.

In the embodiment shown in FIGS. 1–3, the linkage between the spring and the wings of the jaw comprises a longitudinal tie rod 13 which is cylindrical. The tie rod is engaged in the coils of the spring 12. It has at its front end a stop washer 14 against which the front end of the spring is supported. The washer is connected to the end of the spring by a screw 15 which makes it possible to adjust the initial compression of the spring. The screw 15 is accessible from the front of the retention element across an opening of the cap.

Towards the rear, the spring is supported against the support wall 18 which is affixed to the body or to its base. In the embodiment illustrated, the support wall 18 serves likewise as an abutment for the returns 7*a* and 8*a* of the wings, for a rotation of the wings towards the interior. This position in abutment against the support wall defines the rest position of each of the wings. The tie rod 13 extends through the wall 18 and opens towards the rear between the two wings. At this level, it has a portion 20 of a smaller diameter, with a head 21. At the beginning of this portion of smaller diameter, the tie rod has a shoulder 22. On the portion of smaller diameter are mounted a ring 24, on the side of shoulder 22 and a floating rocker 25 on the side of head 21. The floating rocker is wider than head 21, and its dimensions are such that it offers to the returns 7*a* and 8*a* of the wings a support surface through which the returns of the wings can bias the tie rod from front to rear against the return force of the spring. Preferably, the portion 20 of smaller diameter is an independent element which is assembled for example by screwing or any other appropriate means to the rest of the tie rod.

The ring 24 and the rocker 25, although part of the transmission linkage, constitute at least part of an adjustment mechanism which can be set in a particular configuration to act on the remainder of the transmission linkage to modify the release threshold of the jaw in a differential manner with respect to the direction of movement of the jaw.

Rocker 25 is maintained on the portion 20 of the tie rod, in support between its head 21 and the returns 7*a* and 8*a* of the wings. Preferably, head 21 of the tie rod has a square cross section, and the tie rod laterally has two beads which provide a good support for the rocker, particularly in the course of oscillating movements which will be described below. Towards the front, rocker 25 is supported against ring 24. Ring 24 is pivotably mounted around portion 20 of the tie rod. Towards the front, the ring is supported against the shoulder 22. In a preferred manner, the ring has an external diameter equal to that of the front portion of the tie rod, but this is not essential. Preferably likewise, the ring has a length greater than the extent of the tie rod between the position of rest and release of the boot. The assembly of the rocker and the ring is adapted such that, at least at rest, the ring can pivot freely around portion 20. That is to say that the rocker and the ring are mounted on the tie rod between the head and the shoulder 22 with a slight play along a longitudinal direction.

Rocker 25 floats, i.e., it can oscillate in a horizontal plane, as a function of the position and of the displacement of its different supports.

In the embodiment shown, the rocker has a large central opening 27 of rectangular shape. Seen from above, the width of this opening is greater than the diameter of the portion 20 of the tie rod and, preferably, this portion 20 has a small collar 28 with rounded edge, whose external diameter is substantially equal to the width of the opening 27. This small collar serves as a support for the oscillation of the rocker, which will be described in greater detail below. The width of the opening 27 is however less than the diameter of the ring 24.

Seen from the side, opening 27 has a height which is slightly greater than the external diameter of the ring 24. Rocker 25 is adapted such that the portion 20 is at mid height. Any appropriate means may be used.

Ring 24 has on the side of the rocker 25 a planar support surface, which is vertical, except over a quarter of a circle approximately where the support surface is retracted. The planar and vertical zone is referenced at 29 in the figures, and the retracted zone at 30. In the position of the ring shown in FIGS. 1 and 2, this zone 30 is aligned with the longitudinal median plane, towards the bottom, under the portion 20 of the tie rod. It can also be above the portion 20. This position will be qualified below as a median position.

The construction which has just been described functions in the following manner.

Figure 7:
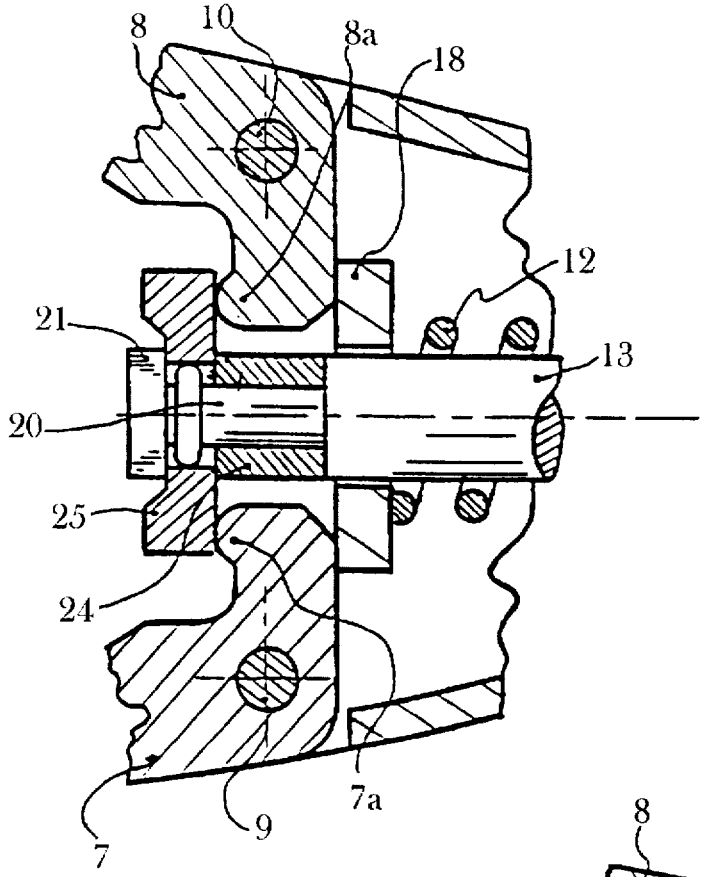
FIG. 7 is a partial views in cross section of the retention element in the area of the linkage between the wings and the tie rod, and with the wings in a closed position.
Figure 8:
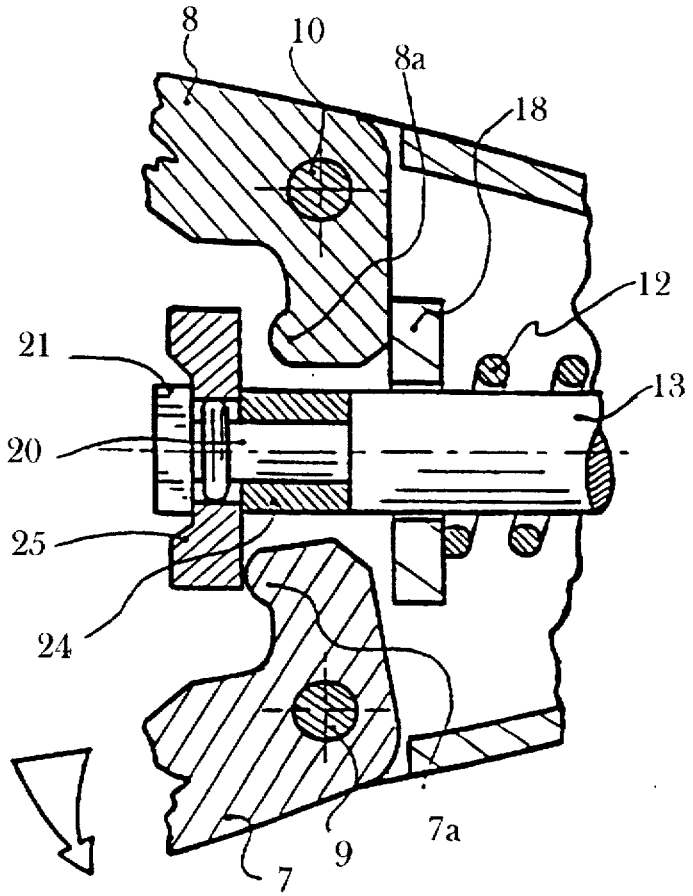
FIG. 8 corresponds to FIG. 7, with one of the wings moved to an open position.

FIGS. 7 and 8 illustrate the linkage between the wings and the tie rod in the median position of the ring. In FIG. 7, the wings are at rest, in the closed position. In FIG. 8, one of the wings, wing 7 in this case, is open. The return 7*a* of the wing drives rocker 25. Rocker 25 is maintained on one side by the head 20 of the tie rod and on the other side, by reaction, it is supported against the ring 24 on both sides of the longitudinal median axis. The rocker is displaced with the tie rod while resting perpendicular to the tie rod.

Figure 9:
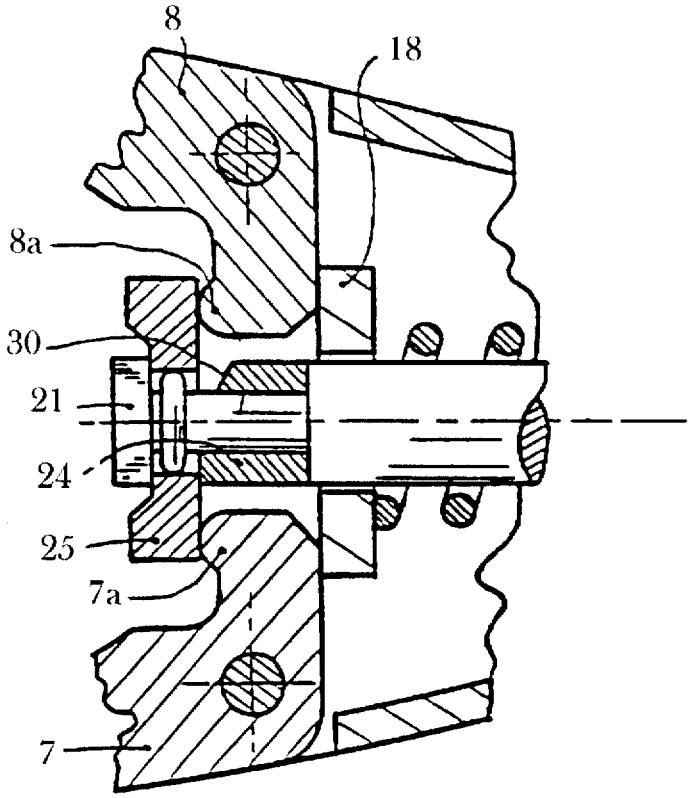
FIG. 9 corresponds to FIG. 7, after a partial rotation of the ring of the transmission linkage.

FIG. 9 illustrates the construction after rotation of the ring 24 over a quarter of a turn. This rotation has brought the retraction zone 30 of the rocker towards the return 8*a* of the wing 8.

Figure 10:
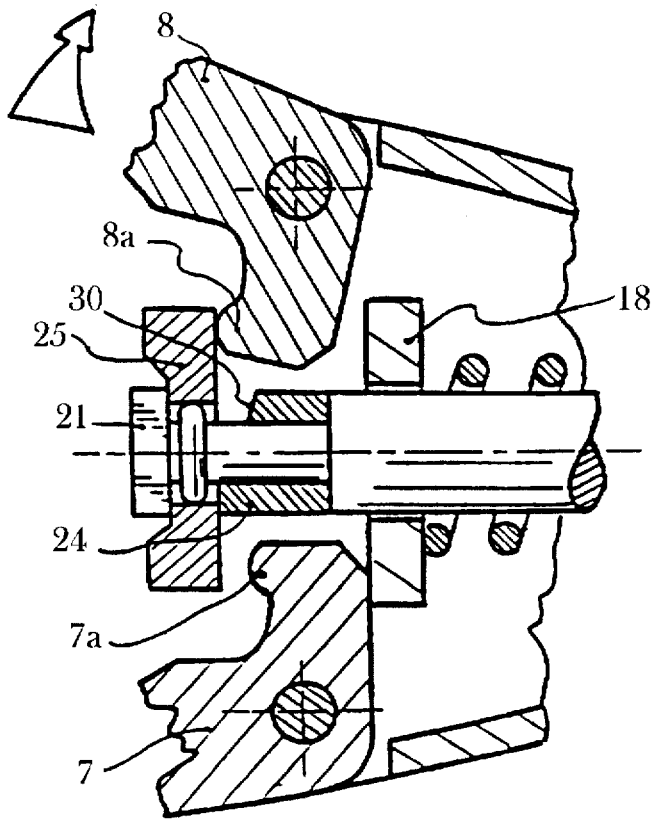
FIG. 10 corresponds to FIG. 9, with one of the wings moved to an open position.

In FIG. 10, wing 8 is open. In its rotational movement, the wing has driven rocker 25. The rocker is supported on the head of the tie rod, and, by reaction on ring 24 in the zone diametrically opposite to the zone 30. The rocker acts in the same manner as that which has previously been described.

FIG. 11 illustrates the rotation of the other wing, i.e., wing 7. As previously, the rocker drives head 21 of the tie rod, but this time, the rocker is supported by reaction no longer against ring 24, but against return 8*a* of the other wing. In effect, the rocker cannot find support against ring 24, because of the retraction zone 30. Wing 8 is itself retained by the support wall 18. Rocker 25 no longer transmits directly its movement to the tie rod, it functions as a lever, which pivots on its support on the return 8*a*. Taking into account the difference of the lever arm, the return force which opposes the opening of the wing is reduced. The opening of wing 7 is facilitated in this position of ring 24.

Preferably, zone 30 is sufficiently retracted such that wing 7 frees the boot before the rocker 25 reaches the end of zone 30. In this manner, rocker 30 remains supported against the return of wing 8, and the reduction effect is maintained. Furthermore, opening 27 of rocker 30 is adapted in height so as not to disturb the oscillation of the rocker, i.e., it is greater than the external diameter of the ring.

It is self-evident that the ring 24 can also be pivoted in the other direction, to obtain the same reduction effect with the opening of the other wing.

The retention element furthermore comprises means to manually determine the position of the ring.

According to the embodiment illustrated, ring 24 has over half of its periphery a channeled or toothed zone 34. The channels or teeth are oriented parallel to the longitudinal direction of displacement of the tie rod. Preferably, this zone is opposite to zone 30 of the ring, and, in the median position of the ring, this zone is positioned on top of the ring.

A rack 35 is provided to mesh with the channels of ring 24. The rack 35 is guided along a translational transverse movement in a groove carried by the support wall 18. Naturally any other appropriate guidance means may be used.

The rack carries in its upper portion a vertical shaft 36. Shaft 36 is engaged in the teeth of a lever 37 in the form of a fork. The lever is pivotably mounted around a vertical axis 38 which extends through the cap 3 of the retention element. Above the cap, the vertical axis 38 is embedded in a element or lever 40 adapted to be activated in a simple manner by hand or with the ski pole. The lever can have any other appropriate means, for example small seats 39 adapted to receive the tip of the ski pole. The assembly is adapted such that a rotation of predetermined angle of the control lever 40 causes the rotation of the ring 24 by a quarter of a turn from one side or the other of its median position.

The lever 40 is visible in FIG. 1 above the cap. It is shown in its median position which corresponds to the median position of the ring 24. There has been shown in FIG. 1 at 40*a* and 40*b* the two directions in which the manipulation lever must be oriented to bring the ring 24 into one or the other of the polarization positions of the retention element which produce an asymmetric release threshold of the boot, smaller on one side than on the other.

It should be noted that, preferably, ring 24 is mounted on portion 20 of the tie rod with a slight play, such that its rotation can be controlled without substantial force when the element is in the rest position. Ring 24 is not really biased against the shoulder of the tie rod except when one retention wing of the boot is biased.

It should also be noted that in the course of skiing, the tie rod is displaced along a longitudinal direction. The rack does not accompany this movement, but its teeth slide along the grooves of ring 24. Furthermore, preferably, the length of the ring has been made greater than the maximum extent of longitudinal displacement of the tie rod.

Figure 14:
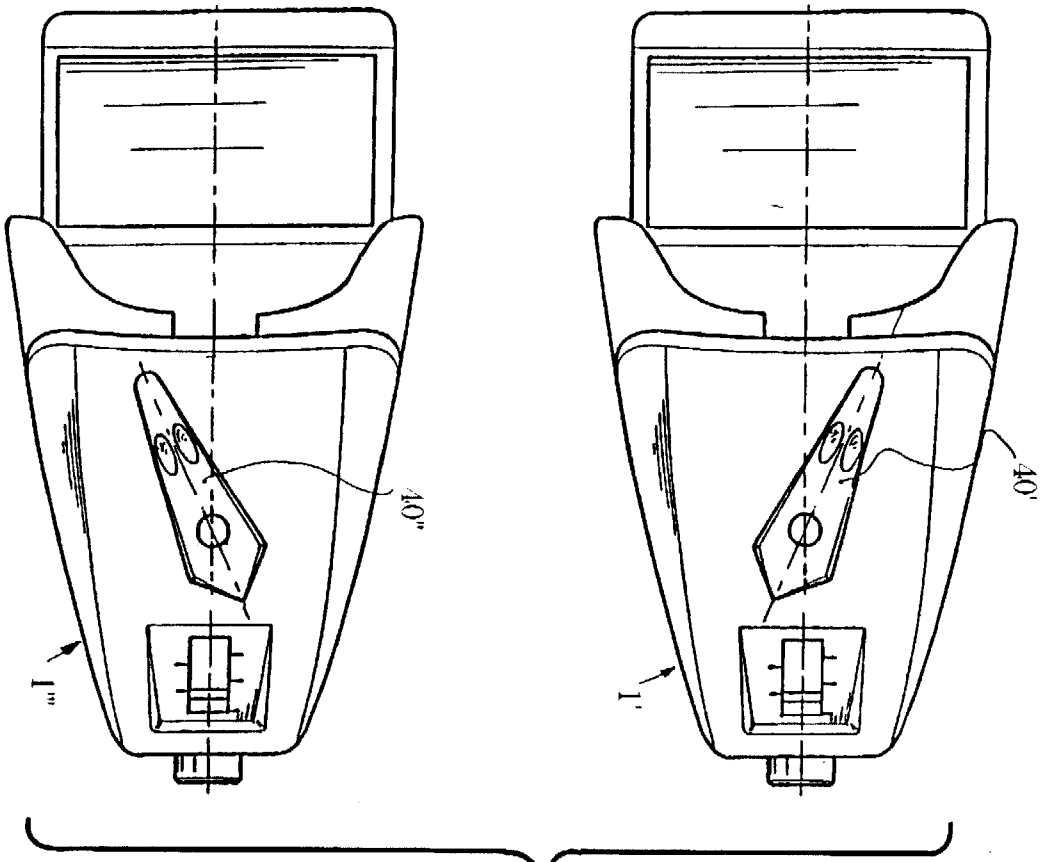
FIG. 14 shows in top view an assembly of two retention elements according to the embodiment of FIG. 1.

FIG. 14 shows an assembly of two retention elements 1' and 1" which are identical to the element 1 previously described. These elements are shown in their position ready for putting on the boot, i.e., the element ready to put on the boot by the right boot is to the right of the other element, and the element adapted to receive the left boot is to the left of the other element of the assembly. Each element has a manipulation lever 40' and 40" identical to the lever 40. As may be seen in FIG. 14, the two manipulation levers have been oriented in opposite and symmetrical directions, to polarize the retention elements in a symmetrical fashion, in a manner such that for each foot of the skier, the boot is freed more easily towards the exterior of the element, corresponding to a rotation of the foot towards the interior.

The manipulation levers make it possible nevertheless to modify at will the polarization of the retention elements.

According to a first preferred mode of use of the assembly shown in FIG. 14, at each usage of the skis, the manipulation levers are oriented along the appropriate polarization, and they are brought back to the median position at the end of each use. For example, for each use, the skier has his skis on the snow next to one another ready for the boots to be inserted, and orients the levers in an appropriate manner according to the relative position of the skis.

According to another mode of use of the assembly, at the end of each use of the skis, the skier leaves the manipulation levers in their position. During another use, he verifies if, in the position where he has prepared his skis ready for insertion of the boots, the respective orientation of the levers is appropriate or not. If it is appropriate, he does not modify the adjustment of the manipulation levers, in effect, the retention elements are correctly polarized. If the levers are not in the proper position, rather than inverting the relative position of the skis, the skier simply inverts the orientation of the levers. By doing this, he brings back each of the retention elements into a correct position. This manipulation is achieved simply, and requires no manipulation of the skis.

It is self-evident that the levers can also be placed in a median position, in which case the skis can be inverted without a problem.

Figure 15:
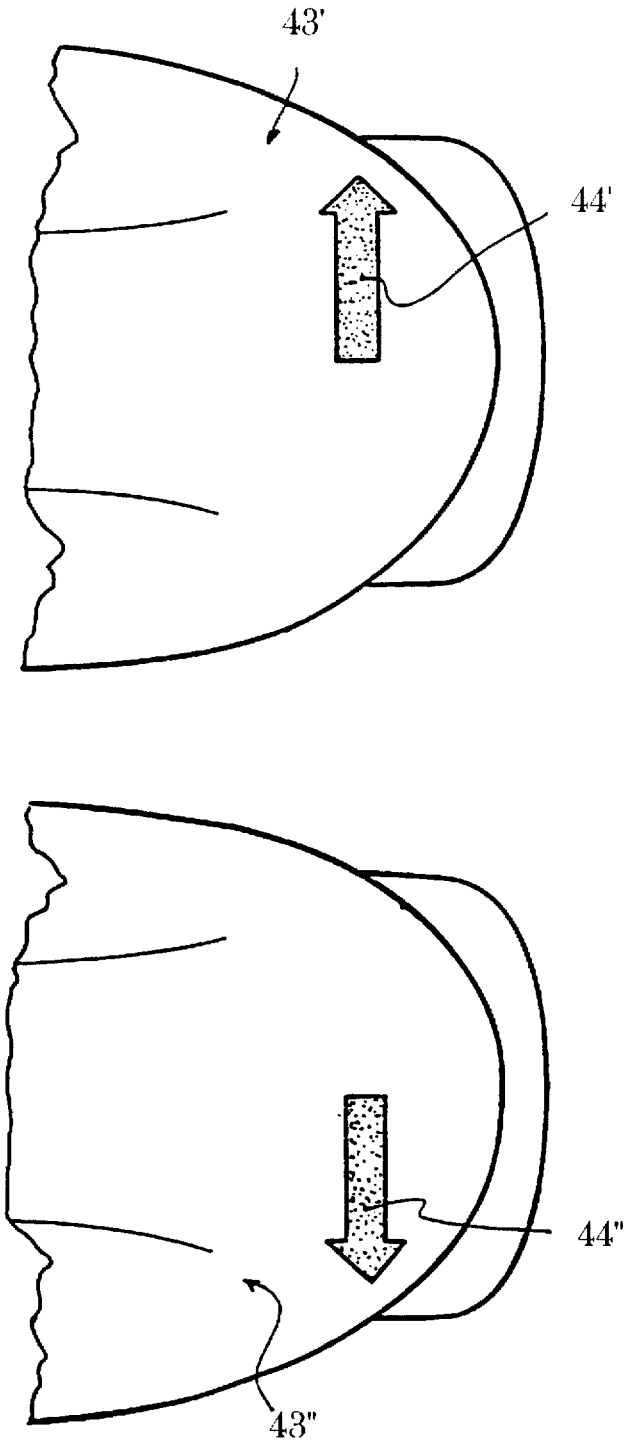
FIG. 15 shows in top view the front of two boots of a pair particularly adapted to the assembly of retention elements of FIG. 14.

To facilitate the correct positioning of the manipulation levers, the boots can have a visual reference which acts to prevent error. For example, as shown in FIG. 15, the two boots 43' and 43" have in front a graphic showing two symmetrical arrows 44', 44", indicating the direction in which the manipulation levers must be pivoted.

Figure 16:
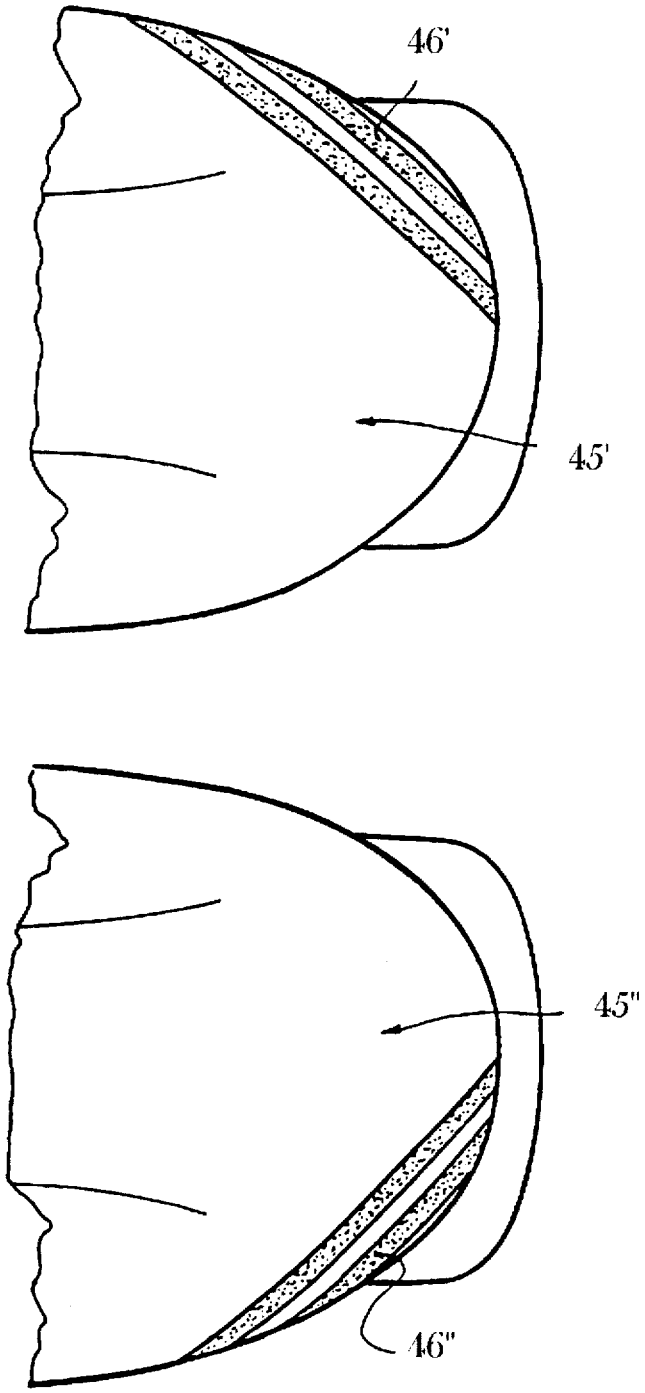
FIG. 16 illustrates an alternative of the embodiment of the front of the boots.

In variation, FIG. 16 shows the front of two boots 45' and 45" which respectively carry graphics 46' and 46" indicating in a suggestive manner the correct orientation of the levers. The graphic causes in effect the orientation of the levers parallel to the lines.

Figure 17:
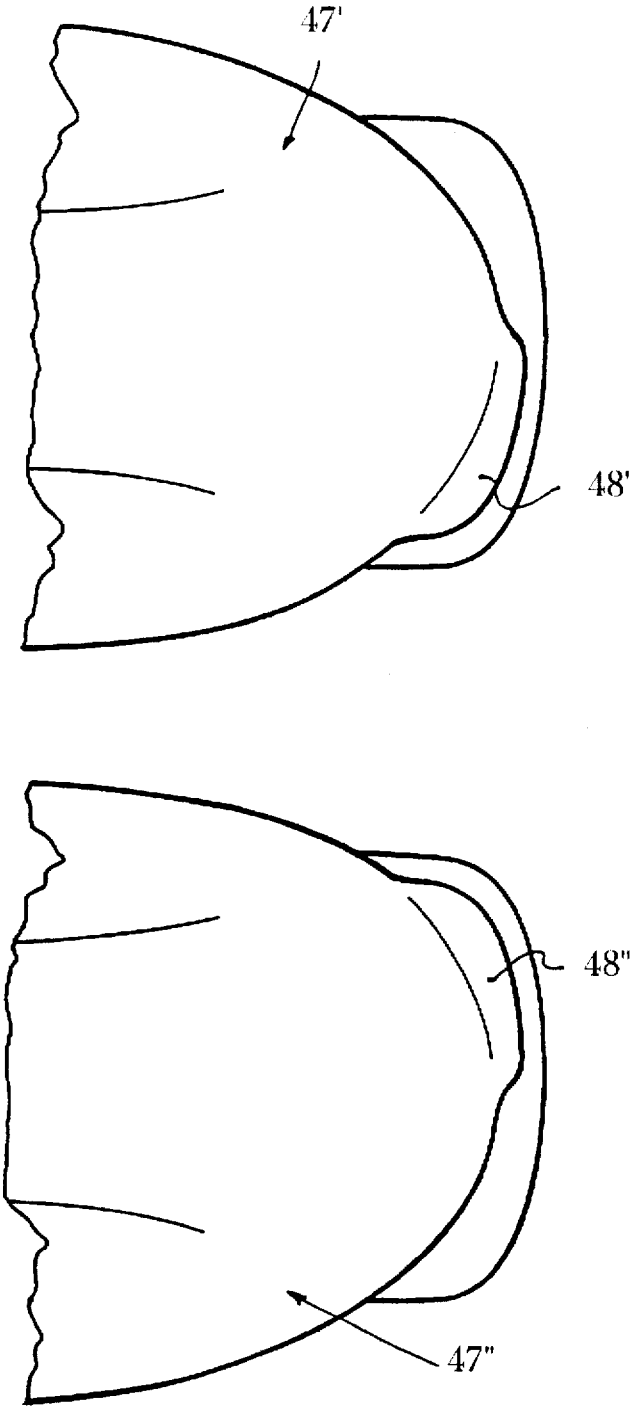
FIG. 17 illustrates another embodiment of the boots.
Figure 20:
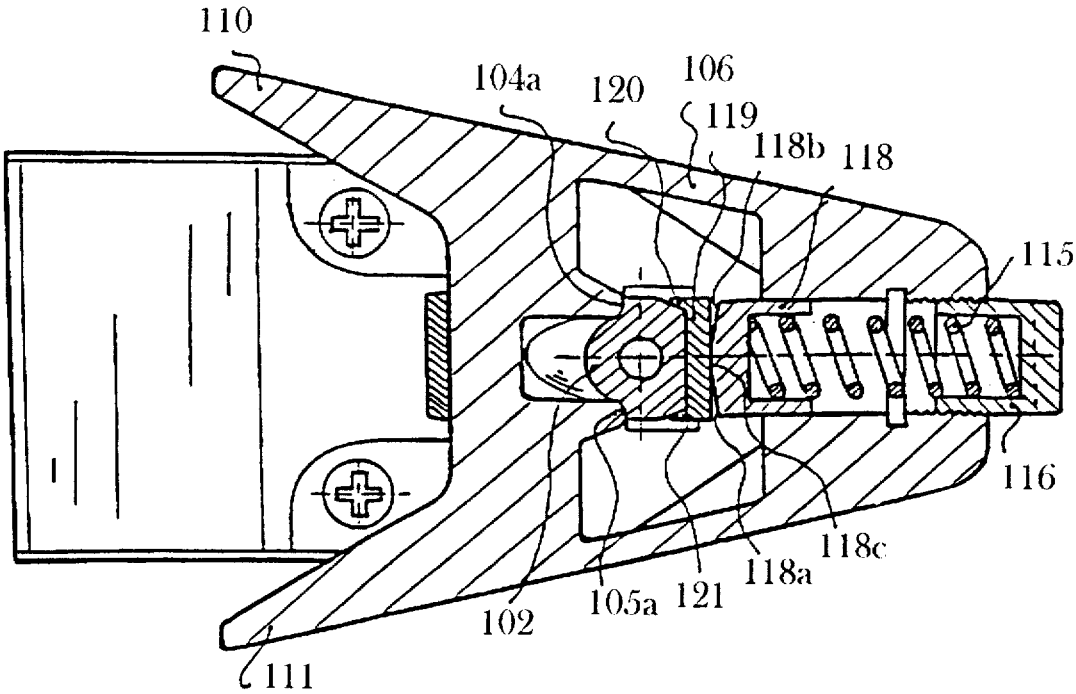
FIG. 20 is a cross sectional view and a top view of the element of FIG. 18.
Figure 21:
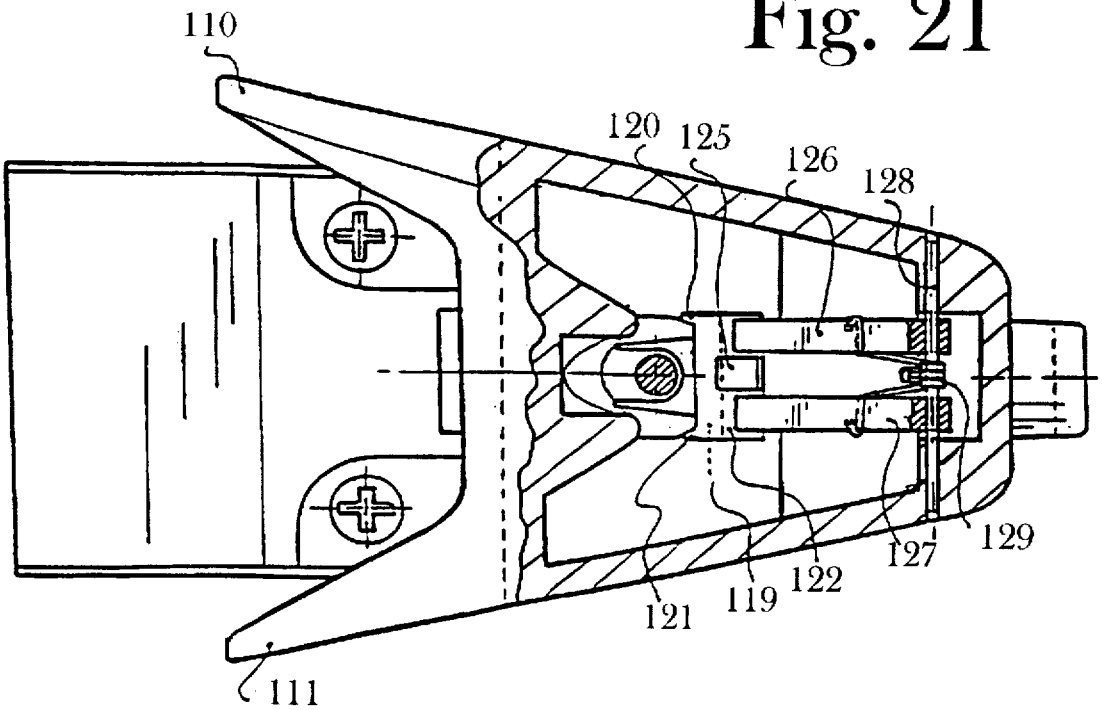
FIG. 21 is a top view in partial cross section at the upper level of FIG. 20.
Figure 22:
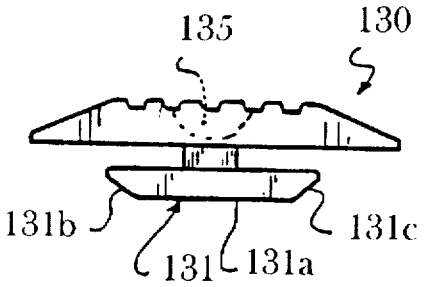
FIG. 22 shows a front view of the manipulation button.
Figure 23:
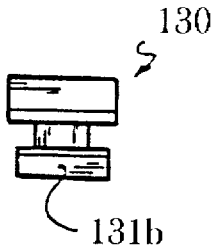
FIG. 23 shows the button in side view.

The boots can also be equipped with an error detector of the mechanical type. To illustrate this, FIG. 17 shows the front of boot 47' and 47" with a portion 48', 48" projecting frontwardly, above the normalized zone. These projections are positioned at the height of the manipulation levers, when the boot is engaged in the retention element. They serve to prevent the engagement of the boot in the retention elements if their respective lever is not in the appropriate position, or median position. Here, projections 48' and 48" prevent the insertion of the boot if the levers are oriented towards the interior.

FIG. 18 relates to another embodiment of the invention. The retention element illustrated is known in large part from French Patent Application No. 2,517,214, the disclosure of which is hereby incorporated by reference thereto.

Element 100 comprises a base 101 adapted to be affixed to the ski by any appropriate means, for example screws.

The base carries a pivot 102 having a screw 103 mounted thereon. In a known manner, the body 106 of the binding element is somewhat suspended at the head of the screw, and by screwing more or less the screw in the pivot, it is possible to adjust the height of the body with respect to the ski. The base and the screw form on the rear two support lines against which body 106 of the retention element is supported. In a known manner, the support lines converge towards the head of the screw, and the body is supported on the pivot by three zones or points, two references 104*a* and 105*a* positioned in the lower portion of the pivot, and the head 103*a* of the screw 103. On its front surface, the base has a transverse surface 108 against which the return spring 115 of the retention element exerts its action.

Towards the rear, the body has a retention jaw for the boot. The jaw comprises two wings 110 and 111 which form with the body a monoblock assembly, or quasi-monoblock assembly if one takes into account the means making it possible to adjust the angular opening of the wings. These means are known and are not referenced in the drawings.

Wings 110 and 111 assure the lateral retention of the boot. Taking into account their position, wings 110 and 111 retain the boot by what is referred to as an upper grip. The standardized tip of the boot has in effect in a known manner a lower portion of the sole, overlaid by an upper portion which forms the base of the upper. It is on this portion that the wings 110 and 111 exert their action. Naturally, this is not limiting, and the other tip grip, referred to as a sole grip is likewise possible. The vertical retention is assured as to itself by the lower portion of the wings which furnish a support surface to the upper portion of the sole. This also is not limiting.

The jaw also comprises a central support point against which the most advanced portion of the upper of the boot is carried.

Towards the front, the binding element has a mechanism for the elastic return of the body to the aligned position with the vertical and longitudinal median plane defined by the longitudinal direction of the ski.

This mechanism comprises in a known manner a spring 115 housed in a longitudinal recess of the body which is closed by a threaded plug 116. One end of the spring rests against this plug whose screwing makes it possible to adjust the stiffness of the retention element, i.e., the initial compression of spring 115.

The other end of the spring acts on the previously described surface 108, by means of a piston 118, and an intermediate flap 119 which will be described below. Preferably, the piston has on its support surface two lateral bevels 118*a* and 118*b* which are slightly inclined. Thus, the support surface of the piston thus has a central surface 118c of triangular shape, seen from the front, and two lateral bevels 118*a* and 118*b*.

In a known manner, spring 115 maintains the body in the stable position aligned with the median plane. Under the effect of lateral biases of the boot, the jaw and the body tend to pivot around one or the other of the support lines of pivot 102, against the return force developed by the spring. In the case of excessive bias, the rotation of the jaw is sufficient to allow for the release of the boot. The bias threshold beyond which the boot is freed is generally referred to as the release threshold. This threshold depends directly on the nature of the spring and on its initial compression. With elements which have been described until now, the release threshold is substantially the same for the two directions of pivoting of the body, from one side or the other of the median plane.

The retention element has an adjustment mechanism acting on the release threshold of the jaw depending upon whether it displaces to one side or the other of its aligned position.

In the embodiment shown in the figures, this mechanism comprise a flat flap 119 which is interposed between piston 118 and support surface 108 of pivot 104. Thus, piston 118 rests on surface 108 of pivot 104 by means of flap 119.

Preferably, the flap 119 laterally has two beads 120 and 121 whose spacing is substantially equal to the width of the surface 108, in a manner such that in the aligned position, the flap is freely nested on surface 108 and pressed against the surface. Furthermore, in its upper portion, the flap has a return 122 which assures the vertical maintenance of the flap by being supported against piston 118.

The support surface of flap 119 and pivot 104 is broader than the support surface of the piston 118 on the flap 119.

Means making it possible to guide the displacement of the flap, by associating it either with the pivot or with the body of the retention element.

Thus, the flap has in its upper portion a stop/catch 125 which projects, aligned with the median plane. On each side of the stop/catch are found a movable catch bolt or member 126, 127, mounted on a transverse journal 128 carried by the body. Each catch bolt is movable between a lower position where it blocks the relative displacement of the stop/catch on the side where the catch bolt is located, and an upper position where it allows for the relative displacement of the stop/catch.

An elastic element, for example a needle spring 129 returns each movable catch bolt to a raised position.

Figure 24:
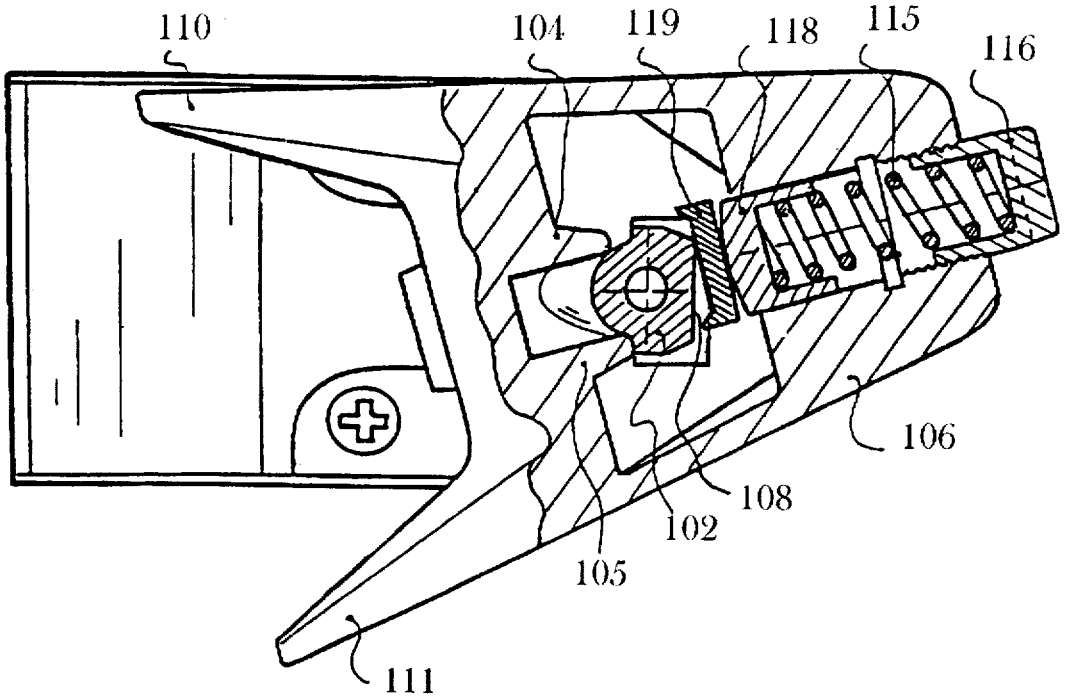
FIGS. 24 illustrate a first mode of operation of the retention element of FIG. 18.

A manipulation element or button 130 is positioned above the body adjacent to the movable end of the catch bolts. The button has an upper portion accessible from the top of the cap of the body, it extends through the cap, and has beneath a control ramp 131 of the position of the catch bolts. The button 130 is movable along a transverse direction. For example, it is guided in a transverse opening of the wall of the body. Ramp 131 has three portions, a central horizontal portion 131*a*, and on each side of this central portion, an inclined portion 131*b* and 131*c* respectively. The button has three principal positions, a median position substantially aligned on the longitudinal median axis. In this position, the horizontal portion 131*a* immobilizes the two catch bolts in the lower position. For each direction of pivoting of the body, the flap 119 is subjected to the movement of the body. FIG. 24 illustrates this mode of operation. The release of the boot is obtained after a rotation of a predetermined angle of the body, for a release threshold defined by compression of spring 115. In the present case, the compression of the body is relatively strong. This compression depends from the support surfaces 102 of the pivot and the surface facing flap 119.

The button can be displaced laterally from each side of this median position. In each of the lateral positions of the button, one of the catch bolts is released, and rises under the action of spring 129.

Figure 25:
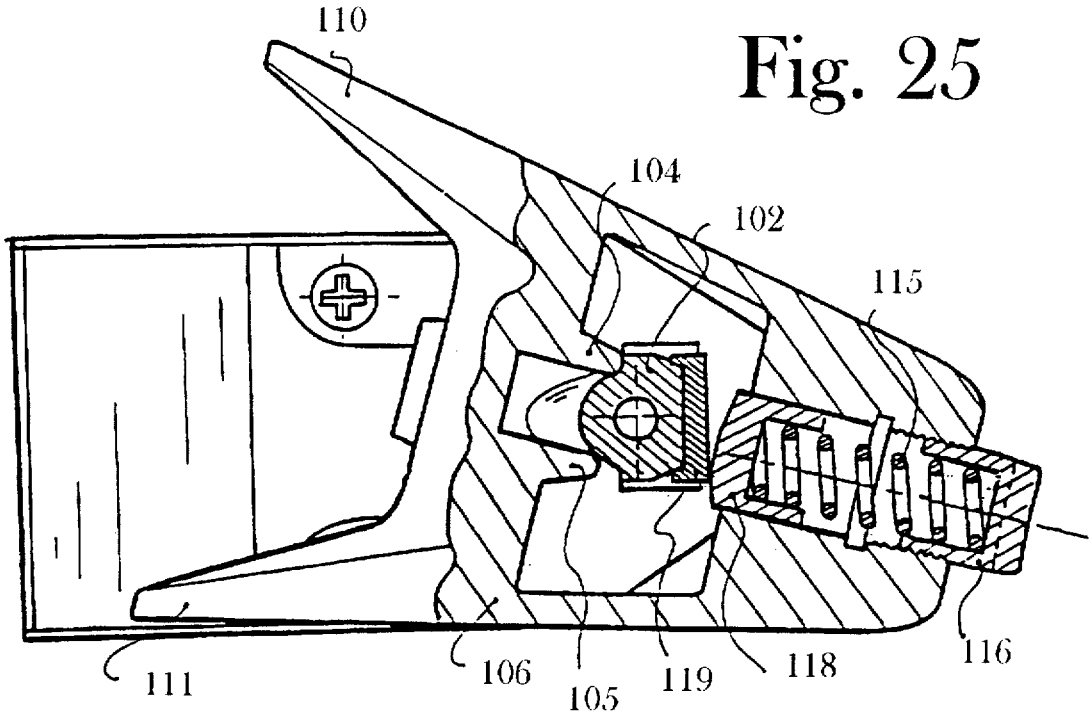
FIG. 25 illustrates a second mode of operation of the retention element of FIG. 18.

For one direction of rotation of the body, the flap 119 remains subjected to the body by the catch bolt which has remained down. For the other direction of rotation, the flap is no longer driven by the catch bolt and remains as a result supported against the surface 108 of the pivot. FIG. 25 illustrates this mode of operation.

Taking into account the shape of the support surface of the piston 118, the release of the boot is reached for a lesser compression of the spring. The release threshold has been lowered. In a certain fashion, button 130 polarizes the retention element by modifying its release threshold for one of its pivoting directions.

The two inclined portions 131*b* and 131*c* of the ramp serve to lower one or the other of the catch bolts when the button is brought back from a lateral position of polarization to the median position.

As in the preceding case, the retention element is adapted to form an assembly with another identical retention element. But the manipulation buttons must be adjusted either in the median position, or in symmetrical positions corresponding to a release threshold which is smaller for a release of the boot corresponding to a torsion of the leg in a direction where the leg is driven towards the interior.

As in the preceding case, if the skis are put on in the wrong direction, the skier can easily change the position of the buttons to return to a correct polarization. To facilitate this manipulation, button 130 can present any appropriate means, for example a small seat 135 adapted to receive the tip of the pole.

As in the preceding case, the boots utilized with the retention elements can have an error detector which causes adjustment of each of the buttons into the appropriate position.

Figure 26:
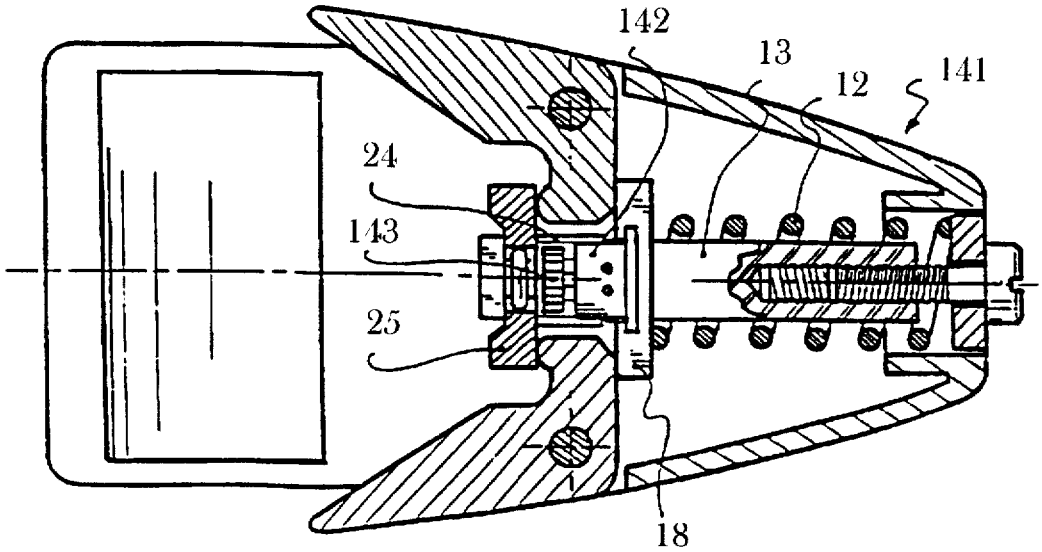
FIG. 26 illustrates in top view and in cross section a retention element according to another way of performing the invention.

FIG. 26 illustrates a retention element 141 which is of the same type as that of FIG. 1, with in particular spring 12, tie rod 13, wall 18, rocker 25 and ring 24. The difference is that the rotation of the ring 24 is piloted electrically, and not mechanically. Ring 24 is here driven rotationally by an electric motor 142 which drives a toothed wheel 143 whose teeth are engaged on the channels of the ring. The motor is affixed for example to the wall 18. It is of any appropriate type, and for example, it is adapted for example to rotate with a pitch corresponding to one quarter of a turn of the toothed wheel. The motor forms at least part of an adjustment mechanism which can be set in a particular configuration to act on the remainder of the transmission linkage to modify the release threshold of the jaw in a differential manner with respect to the direction of movement of the jaw. The rotation of the motor is controlled by an interrupter or rocker switch whose movable portion or manipulation element has three stable positions, and is at least in part accessible from the exterior, for example above the cap of the retention element. Such a switch is shown in FIG. 27 under the reference 145. This switch has a body 146 which is affixed to the cap of the retention element, and a movable portion 147 which is oriented along a transverse direction, and journalled around a longitudinal axis. Above the cap, the movable portion has two surfaces in the form of an open "V".

FIG. 28 shows the movable portion in its median position, which corresponds to the median position of the ring.

FIG. 29 shows the movable portion in one of its stable lateral positions. This position is for example imposed by support on one of the surfaces of the movable portion, by means of the ski pole. In this position, the interrupter controls the rotation of the motor 142 to make ring 24 pivot towards the polarization position which is assigned to it. The position of the movable portion of the interrupter furthermore shows the polarization of the retention element. In other words, depending upon the surface of the interrupter which is embedded towards the cap, it is possible to see if the retention element is polarized as right element or left element.

The interrupter 145 and the motor are coupled by electric means, particularly a battery and connectors. These means are of a known type and will not be described in detail.

Naturally, the present description is not limited to the different embodiments and various embodiments which have been described, and numerous variations are possible. In particular the invention can be adapted to other known constructions of the retention element than those which have been described. Furthermore, instead of being placed above the body, the manipulation buttons can be placed in front of the retention element, on the side, or in any other appropriate zone.

The instant application corresponds to the invention disclosed in French priority application 94.14072, filed Nov. 21, 1994, the disclosure of which is hereby incorporated by reference thereto, and the priority of which is hereby claimed under 35 U.S.C. § 119.

Finally, although the invention has been described with reference to particular means, materials and embodiments, it is to be understood that the invention is not limited to the particulars disclosed and extends to all equivalents within the scope of the claims.

What is claimed:

1. An apparatus for retaining a boot upon a gliding board, said apparatus comprising:

a retention jaw adapted to retain an end of the boot, said jaw having at least a horizontal component of movement from a central position aligned with a longitudinal median plane to either respective side of said longitudinal median plane;

a return spring effective to define a release threshold of the jaw with respect to release movement of said jaw from said central position;

a transmission linkage between said retention jaw and said spring to compress said spring in response to movement of said jaw from said central position to either respective side of said longitudinal median plane, said spring exerting an elastic return force to said jaw toward said central position;

said jaw and said spring being adapted to free the end of the boot beyond a predetermined release threshold force corresponding to a predetermined amplitude of displacement of said jaw and to a predetermined extent of compression of said spring;

an adjustment mechanism connected to said transmission linkage, said adjustment mechanism being selectively positionable to be set in each of a plurality of configurations with respect to said transmission linkage, at least one of said configurations modifying said release threshold of said jaw, defined by said return spring, differently with respect to movement of said jaw from said central position toward said respective sides; and a manipulation element operatively connected to said adjustment mechanism to set said adjustment mechanism in said configuration for differentially modifying said release threshold of said jaw, said manipulation element being positioned for access to a user.

2. An apparatus according to claim 1, further comprising:

a body having an upper surface;

wherein said manipulation element is mounted above said upper surface of said body; and wherein said manipulation element is connected to said adjustment mechanism for rotation about an upwardly extending axis.

3. An apparatus according to claim 2, wherein:

said manipulation element-is connected to said adjustment mechanism by means of an axle extending through said upper surface of said body; and said adjustment mechanism further comprises a lever connected to said axle, said lever being rotatable about said axle.

4. An apparatus according to claim 3, wherein:

said lever includes an end remote from said axle;

said adjustment mechanism further comprises a rack connected to said remote end of said lever, said rack being guided for translational transverse movement in response to activation of said manipulation element by the user.

5. An apparatus according to claim 4, wherein:

said transmission linkage comprises a tie rod extending along a longitudinal axis;

said adjustment mechanism further comprises a ring mounted for free rotation about said longitudinal axis; and said ring includes a toothed peripheral zone, said rack being meshed with said toothed zone of said ring.

6. An apparatus according to claim 5, wherein:

said tie rod includes a shoulder, said ring being supported against said shoulder;

said tie rod includes a head spaced from said shoulder;

said adjustment mechanism further includes a rocker through which said tie rod extends, said rocker being positioned between said ring and said head of said tie rod and being mounted on said tie rod to pivot in at least a horizontal component of motion; and said ring further includes a retracted zone facing said rocker.

7. An apparatus according to claim 1, further comprising:

a body having an upper surface;

wherein said manipulation element is mounted above said upper surface of said body; and wherein said manipulation element is connected to said adjustment mechanism for translational transverse movement.

8. An apparatus according to claim 7, wherein:

said manipulation element is in a median position when said jaw is in said central position;

said adjustment mechanism comprises a pair of catch bolts; and said manipulation element is movable to a first lateral position, on a first side of said median position, to block movement of one of said catch bolts and to a second lateral position, on a second side of said median position, to block movement of a second of said catch bolts.

9. An apparatus according to claim 8, wherein:

said jaw is mounted for movement with respect to a base;

said base has a support surface for said spring;

said transmission linkage comprises a movable flap positioned between said spring and said support surface for said spring, said flap having a catch extending therefrom;

said catch bolts are positioned for independent pivoting around a transverse axis from a first height above said catch to a second height for engagement with said catch.

10. An apparatus according to claim 1, wherein:

said transmission linkage comprises a tie rod extending along a longitudinal axis;

said adjustment mechanism further comprises a ring mounted for free rotation about said longitudinal axis, said ring including a toothed peripheral zone;

said adjustment mechanism further comprises a toothed wheel meshed with said toothed peripheral zone of said ring; and said adjustment mechanism further comprises an electric motor connected to said toothed wheel for rotating said toothed wheel and, consequently, said ring.

11. An apparatus according to claim 10, wherein:

said manipulation element comprises a control switch for controlling said electric motor to move said toothed wheel selectively in either direction of rotation and, consequently, to drive said ring.

12. An apparatus according to claim 10, wherein:

said tie rod includes a shoulder, said ring being supported against said shoulder;

said tie rod includes a head spaced from said shoulder;

said adjustment mechanism further includes a rocker through which said tie rod extends, said rocker being positioned between said ring and said head of said tie rod and being mounted on said tie rod to pivot in at least a horizontal component of motion; and said ring further includes a retracted zone facing said rocker.

13. An apparatus according to claim 1, wherein:

said longitudinal median plane corresponds to a longitudinal median plane of the gliding board; and said return spring extends along said longitudinal median plane of the gliding board.

14. An assembly comprising two of said apparatus according to claim 1, wherein:

each of said two apparatus being adapted to retain one of a pair of boots upon a respective ski.

15. An assembly according to claim 14 in combination with said pair of boots, wherein:

each of said boots has a visual marking indicative of a correct position of a respective manipulation element.

16. An assembly according to claim 14 in combination with said pair of boots, wherein:

each of said boots has an error preventing structure for cooperation with a respective manipulation element to prevent retention of said boots by said apparatus with said manipulation elements in an incorrect position.

17. An assembly according to claim 14, wherein:

each said apparatus is identical to the other.

18. An apparatus according to claim 1, wherein:

said return spring is operatively connected to said jaw by said transmission linkage for exerting an elastic return force to move said jaw to said central position following release movement of said jaw from said central position to either side of said longitudinal median plane.

19. An apparatus according to claim 1, wherein:

said manipulation element consists of a single manipulation element.

20. An apparatus for retaining a boot upon a gliding board, said apparatus comprising:

a retention jaw adapted to retain an end of the boot, said jaw having at least a horizontal component of movement from a central position aligned with a longitudinal median plane to either respective side of said longitudinal median plane;

a return spring effective to define a release threshold of the jaw with respect to release movement of said jaw from said central position;

a transmission linkage between said retention jaw and said spring to compress said spring in response to movement of said jaw from said central position to either respective side of said longitudinal median plane, said spring exerting an elastic return force to said jaw toward said central position;

said jaw and said spring being adapted to free the end of the boot beyond a predetermined release threshold force corresponding to a predetermined amplitude of displacement of said jaw and to a predetermined extent of compression of said spring;

means connected to said transmission linkage for selectively enabling said release threshold, defined by said return spring: (1) to be maintained and (2) to be set differently dependent upon a direction of movement of said jaw from said central position; and a single manipulation element operatively connected to said means.

21. An apparatus according to claim 20, wherein:

said longitudinal median plane corresponds to a longitudinal median plane of the gliding board; and said return spring extends along said longitudinal median plane of the gliding board.

22. An apparatus according to claim 20, wherein:

said return spring is operatively connected to said jaw by said transmission linkage for exerting an elastic return force to move said jaw to said central position following release movement of said jaw from said central position to either side of said longitudinal median plane.

* * * * *